US009436143B2

(12) United States Patent
Ishikawa et al.

(10) Patent No.: US 9,436,143 B2
(45) Date of Patent: Sep. 6, 2016

(54) FIXING APPARATUS, IMAGE FORMING APPARATUS AND TEMPERATURE CONTROL METHOD OF FIXING APPARATUS

(71) Applicant: Konica Minolta, Inc., Chiyoda-ku, Tokyo (JP)

(72) Inventors: Tetsuya Ishikawa, Sagamihara (JP); Hiroshi Morimoto, Akiruno (JP); Kazuteru Ishizuka, Saitama (JP); Kei Okamura, Yokohama (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/734,642

(22) Filed: Jun. 9, 2015

(65) Prior Publication Data

US 2015/0355584 A1 Dec. 10, 2015

(30) Foreign Application Priority Data

Jun. 10, 2014 (JP) ..... 2014-119545

(51) Int. Cl.
*G03G 15/20* (2006.01)
*G03G 15/00* (2006.01)

(52) U.S. Cl.
CPC ..... *G03G 15/2046* (2013.01); *G03G 15/205* (2013.01); *G03G 15/6517* (2013.01); *G03G 2215/00455* (2013.01)

(58) Field of Classification Search
CPC ..... G03G 15/205; G03G 2215/00455–2215/00459
USPC ..... 399/384
See application file for complete search history.

(56) References Cited

U.S. PATENT DOCUMENTS

| | | | | |
|---|---|---|---|---|
| 4,218,499 | A * | 8/1980 | Shinohara | G03G 15/2032 118/60 |
| 5,087,947 | A * | 2/1992 | Torino | G03G 15/2032 219/216 |
| 5,109,255 | A * | 4/1992 | Nishikawa et al. | B41J 15/06 219/216 |
| 5,956,554 | A * | 9/1999 | Yanashima | G03G 15/2064 399/328 |
| 7,346,306 | B2 * | 3/2008 | Cho | G03G 15/2039 399/329 |
| 8,894,303 | B2 * | 11/2014 | Monclus | B41J 11/002 399/388 |
| 2011/0229183 | A1 * | 9/2011 | Seki | G03G 15/50 399/82 |

FOREIGN PATENT DOCUMENTS

| | | | |
|---|---|---|---|
| JP | 02103076 | A | 4/1990 |
| JP | 2010002606 | A * | 1/2010 |

* cited by examiner

*Primary Examiner* — David Gray
*Assistant Examiner* — Leon W Rhodes, Jr.
(74) *Attorney, Agent, or Firm* — Cantor Colburn LLP

(57) ABSTRACT

A fixing apparatus includes a heating unit configured to heat an endless belt stretched around a plurality of rollers, a lower pressure roller pressed into contact with the fixing belt, and a control unit configured to control the temperature of the fixing belt by controlling the heating unit, and fixes an unfixed toner image formed on a continuous paper to the continuous paper by heat from the heated object under a nipping pressure applied at the nip portion which is formed by engagement between the fixing belt and the lower pressure roller. The control unit controls the temperature of the fixing belt to be a stand-by temperature lower than such a first temperature, which is set up in advance, that paper trouble might occur if the continuous paper is continuously heated at a temperature not lower than the first temperature in a stand-by state in which fixing is not performed.

12 Claims, 5 Drawing Sheets

FIXING APPARATUS, IMAGE FORMING APPARATUS AND TEMPERATURE CONTROL METHOD OF FIXING APPARATUS

CROSS-REFERENCE TO RELATED APPLICATIONS

The present application claims priority under 35 U.S.C. §119 to Japanese Patent Application No. 2014-119545, filed Jun. 10, 2014. The contents of this application are herein incorporated by reference in their entirety.

The present invention relates to a fixing apparatus for fixing images formed on sheet, an image forming apparatus and a temperature control method of the fixing apparatus.

DESCRIPTION OF RELATED ART

Conventionally, a fixing unit is known which forms a nip portion by pressure engaging a pair of rollers one of which is heated, conveying a sheet on which an unfixed toner image is formed to the nip portion, and fixes the unfixed toner image to the sheet by the nip pressure of the nip portion and heat of the one roller. It has been proposed to design such a fixing unit which is capable of performing a fixing process on so-called continuous paper, e.g., rolled or folded paper.

In the case where the fixing unit performs the fixing process on continuous paper, this continuous paper is left as it is in a stand-by state after completing a job. Also, in the fixing unit, one of the rollers which is heated is maintained at a relatively high temperature, for example, 180° C. even in the stand-by state for the purpose of improving the productivity. For this reason, in the case where the continuous paper is a resin base synthetic paper which is made mainly of polypropylene resin or the like, severe damage may occur in the fixing unit by the continuous paper exposed to heat from the heated roller for a substantial time and melted. Furthermore, the heat from the heated roller may cause bubble-like blisters in the case where the continuous paper is made of a coated paper and may discolor the paper in the case where the continuous paper is made of a standard paper. Because of this, there is a problem that the output quality of printing process is significantly degraded.

In view of this problem, another fixing unit has been proposed with a mechanism of separating the pair of rollers and retracting continuous paper from the heated roller in a stand-by state after completing a job (refer to Japanese Patent Published Application No. 2-103076). In accordance with this fixing unit, the continuous paper is prevented from being in contact with the heated roller in a stand-by state so that the above severe damage and quality degradation can be avoided.

However, the fixing unit described in Japanese Patent Published Application No. 2-103076 requires a dedicated mechanism provided for separating the pair of rollers and retracting continuous paper from the heated roller so that the configuration of the system tends to be complicated resulting in cost increase. Incidentally, this problem will not only occur in the fixing unit having a pair of rollers between which a nip portion is formed, but also occur in a fixing unit having a roller and an endless fixing belt between which a nip portion is formed.

SUMMARY OF THE INVENTION

To achieve at least one of the abovementioned objects, reflecting one aspect of the present invention, a fixing apparatus comprises: a heating unit configured to heat a heated object which is either a roller or an endless belt stretched around a plurality of rollers; an another roller pressed into contact with the heated object in order to form a nip portion between the another roller and the heated object; and a control unit configured to control the temperature of the heated object by controlling the heating unit. Particularly, the fixing apparatus is configured to fix an unfixed toner image formed on a continuous paper to the continuous paper by heat from the heated object under a nipping pressure applied at the nip portion. The control unit controls the temperature of the heated object to be a stand-by temperature lower than such a first temperature, which is set up in advance, that paper trouble might occur if the continuous paper is continuously heated at a temperature not lower than the first temperature in a stand-by state in which fixing is not performed.

Also, to achieve at least one of the abovementioned objects, reflecting one aspect of the present invention, a temperature control method is provided for controlling a heated object of a fixing apparatus which includes: a heating unit configured to heat the heated object which is either a roller or an endless belt stretched around a plurality of rollers; and an another roller pressed into contact with the heated object in order to form a nip portion between the another roller and the heated object. The fixing apparatus is configured to fix an unfixed toner image formed on a continuous paper to the continuous paper by heat from the heated object under a nipping pressure applied at the nip portion. The temperature control method includes a controlling step of controlling the heating unit to control the temperature of the heated object to be a stand-by temperature lower than such a first temperature, which is set up in advance, that paper trouble might occur if the continuous paper is continuously heated at a temperature not lower than the first temperature in a stand-by state in which fixing is not performed.

BRIEF DESCRIPTION OF THE DRAWINGS

The present invention is illustrated by way of example and not limitation in the figures of the accompanying drawings, which are not drawn to scale, in which like elements are labeled similarly, and in which.

DETAILED DESCRIPTION OF THE PREFERRED EMBODIMENT

Hereinafter, a description is given of embodiments of the present invention with reference to the drawings.

Figure 1:
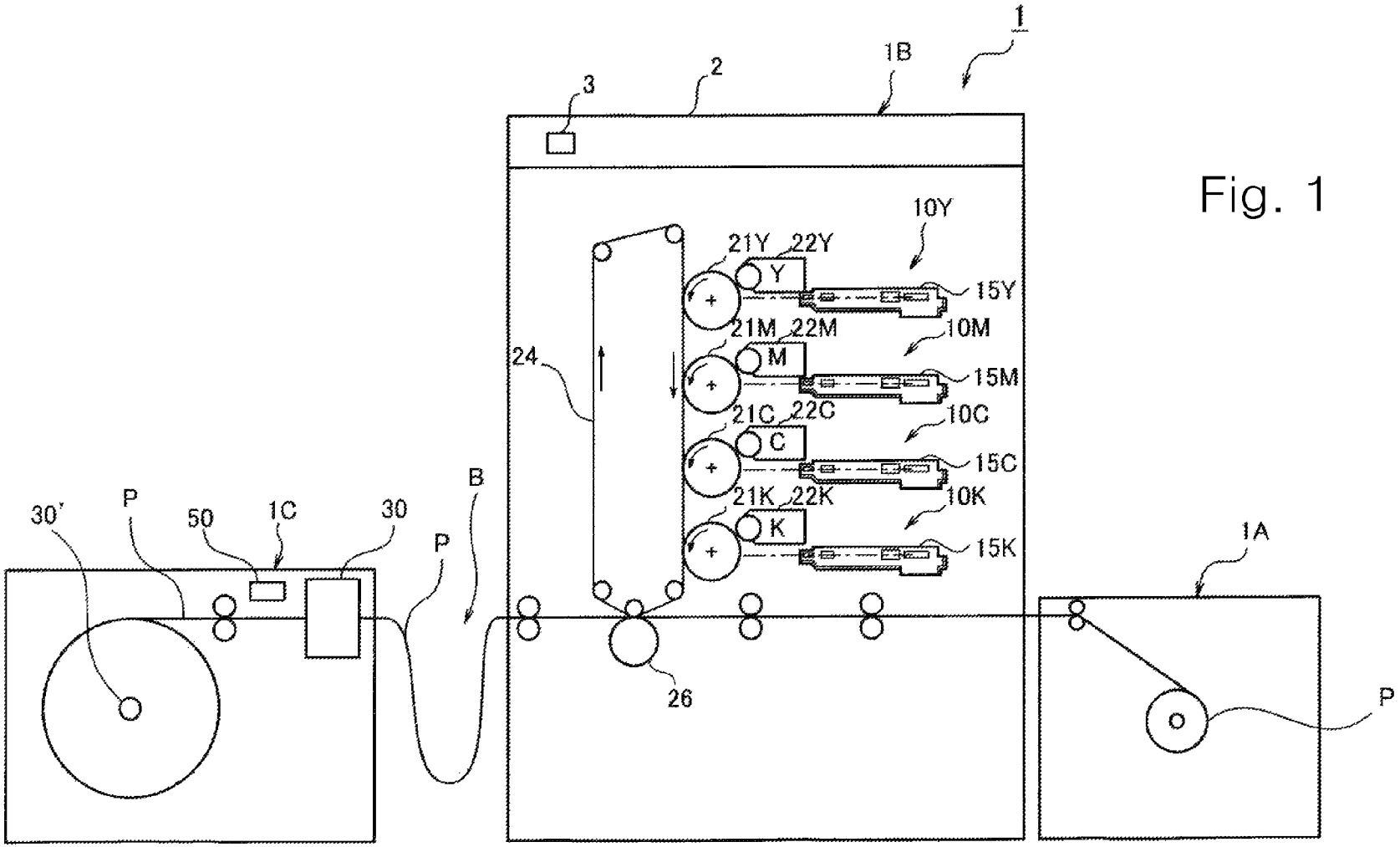
FIG. 1 is a view for schematically showing an image forming apparatus which includes a fixing apparatus in accordance with a first embodiment.

FIG. 1 is a view for schematically showing an image forming apparatus which includes a fixing apparatus in accordance with a first embodiment. This image forming apparatus 1 is provided with a continuous paper supply unit 1A, an image forming apparatus body 1B and a continuous paper winding unit 1C.

The continuous paper supply unit 1A is used to store continuous paper P. The continuous paper supply unit 1A supplies the continuous paper P to the image forming apparatus body 1B in response to an instruction from the image forming apparatus body 1B. The continuous paper P is a roll paper which is rolled up around its axis. Alternatively, the continuous paper P may be a folded paper. The continuous paper P may be provided with perforations aligned in the width direction such that a paper sheet can be easily separated from the continuous paper P by the perforations after printing.

The image forming apparatus body 1B is, for example, a copying machine which electrophotographically forms images. The image forming apparatus body 1B is a tandem color image forming apparatus which includes a plurality of photoreceptor drums vertically arranged in contact with one intermediate transfer belt to form full-color images.

The image forming apparatus body 1B consists mainly of an original reading unit 2, a main control unit 3, and image forming units 10Y, 10M, 10C and 10K, which are installed within one housing. The original reading unit 2 scans and exposes the image of an original with an optical system of a scanning exposing device, and reads the reflected light therefrom with a line image sensor to obtain image signals. The image signals are processed by performing A/D conversion, shading compensation, data compression and so on, and input to the main control unit 3 as image data. The image data input to the main control unit 3 is not limited to the image data as captured by the original reading unit 2, but can be the data for example as received from another image forming apparatus, a personal computer or the like connected to the image forming apparatus body 1B, or stored in a portable recording medium such as a USB memory.

The image forming units 10Y, 10M, 10C and 10K are an image forming unit 10Y for forming yellow (Y) images, an image forming unit 10M for forming magenta (M) images, an image forming unit 10C for forming cyan (C) color images, and an image forming unit 10K for forming black (K) images.

The image forming unit 10Y is provided with a photoreceptor drum 21Y, and a charging unit (not shown in the figure), a development apparatus 22Y and an optical writing unit 15Y which are arranged near the photoreceptor drum 21Y. Likewise, the other image forming units 10M, 10C and 10K are provided with photoreceptor drums 21M, 21C and 21K, and charging units (not shown in the figure), development apparatuses 22M, 22C and 22K and optical writing units 15M, 15C and 15K which are arranged near the photoreceptor drums 21M, 21C and 21K respectively.

The surfaces of the photoreceptor drums 21Y, 21M, 21C and 21K are uniformly charged with electricity by the charging units, and the optical writing units 15Y, 15M, 15C and 15K perform a scanning exposure process to form latent images on the photoreceptor drums 21Y, 21M, 21C and 21K respectively. The development apparatuses 22Y, 22M, 22C and 22K then make visible the latent images on the photoreceptor drums 21Y, 21M, 21C and 21K respectively by developing the images with toners. Predetermined color images (toner images) are thereby formed on the photoreceptor drums 21Y, 21M, 21C and 21K respectively corresponding to yellow, magenta, cyan and black.

The image forming units 10Y, 10M, 10C and 10K of the first embodiment include an intermediate transfer belt 24 and a second transfer roller 26. The toner images formed on the photoreceptor drums 21Y, 21M, 21C and 21K are transferred to a predetermined location of an intermediate transfer belt 24 which is an endless belt through first transfer rollers (not shown in the figure).

The image consisting of respective color images transferred to the intermediate transfer belt 24 is transferred to the continuous paper P with a predetermined timing by a second transfer unit 26. By this process, an unfixed toner image is formed on the continuous paper P. The second transfer roller 26 is a rotary member in the form of a roller. The second transfer roller 26 is provided in contact with the intermediate transfer belt 24 under pressure to form a nip portion therebetween. The second transfer roller 26 transfers the image onto the continuous paper P which is being conveyed.

After transferring the image as described above, the continuous paper P is supplied to the continuous paper winding unit 1C. The continuous paper winding unit 1C performs a fixing process for the unfixed toner image transferred to the continuous paper P supplied from the image forming apparatus body 1B. After performing the fixing process, the continuous paper winding unit 1C winds the continuous paper P around a winding member 30'. The continuous paper winding unit 1C is provided with a fixing unit 30 and a control unit 50.

Figure 2:
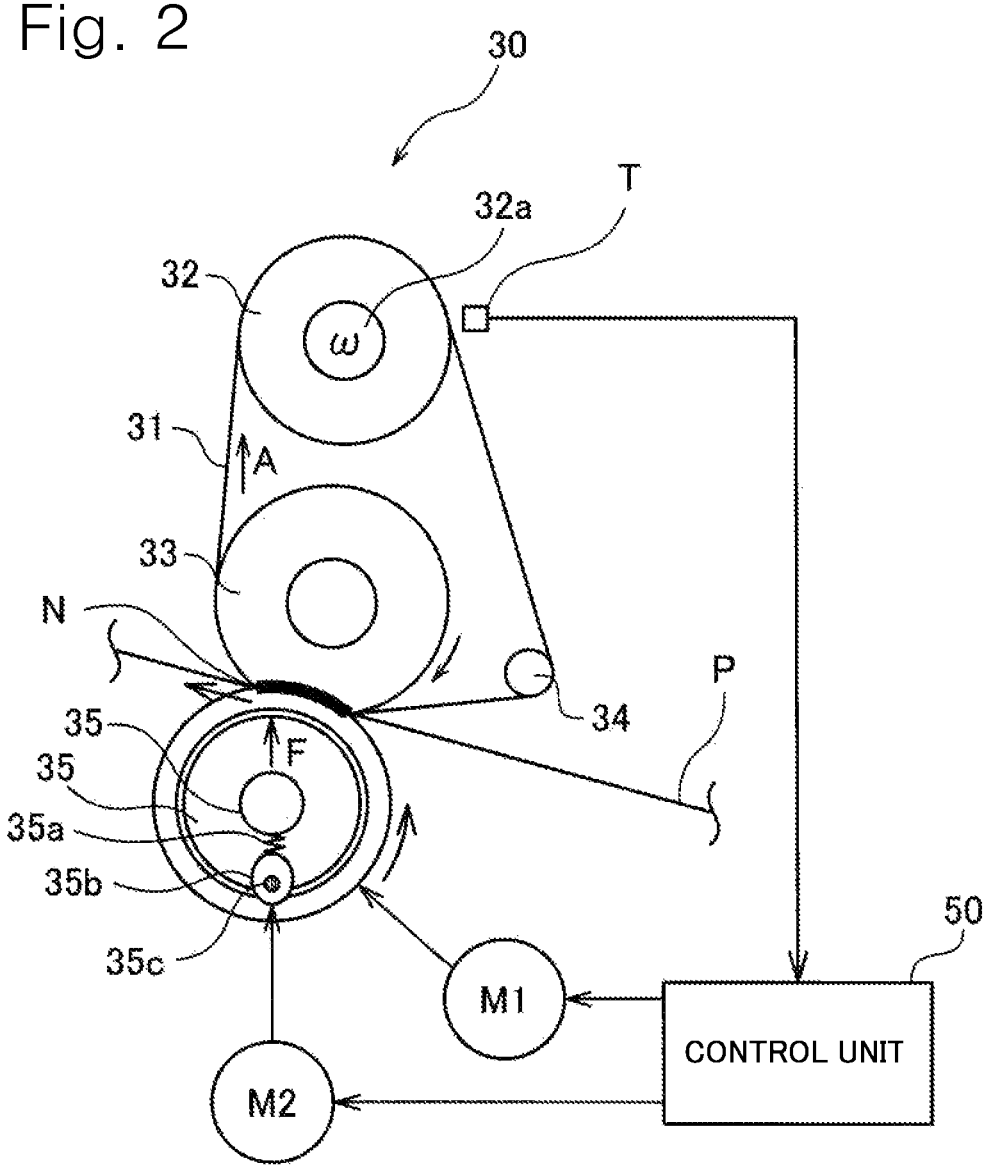
FIG. 2 is a view for showing the details of the fixing unit shown in FIG. 1.

The fixing unit 30 serves as a fixing apparatus in cooperation with the control unit 50. The fixing unit 30 performs a fixing process for fixing an unfixed toner image to the continuous paper P. FIG. 2 is a view for showing the details of the fixing unit 30 shown in FIG. 1. As illustrated in FIG. 2, the fixing unit 30 includes an endless fixing belt (heated object) 31, a heating roller 32 (one of a plurality of rollers around which the endless belt is stretched), an upper pressure roller (one of the plurality of rollers) 33, a stretching member (one of the plurality of rollers) 34, a lower pressure roller (another roller) 35, and motors M1 and M2.

The fixing belt 31 is wound and stretched around the heating roller 32, the upper pressure roller 33 and the stretching member 34 with a predetermined belt tension. When the lower pressure roller 35 is rotationally driven as described below, the fixing belt 31 rotates in the direction indicated with arrow A as illustrated in FIG. 2.

The heating roller 32 incorporates a halogen heater as a heat source (heating unit) 32*a* for heating the fixing belt 31. The heat source 32*a* is controlled by the control unit 50 to turn on and off. When the heat source 32*a* is turned on, the fixing belt 31 is heated through the heating roller 32. The fixing unit 30 is provided with a temperature sensor T in the vicinity of the heating roller 32. The control unit 50 controls the heat source 32*a* to turn on and off on the basis of the temperature detected by the temperature sensor T.

The upper pressure roller 33 is brought into pressure contact with the lower pressure roller 35 through the fixing belt 31. A fixing nip portion (nip portion) N is formed by this pressure contact.

The lower pressure roller 35 is rotationally driven by a drive motor M1 which is a main driving source. When the lower pressure roller 35 is rotated by the drive motor M1, the fixing belt 31, the upper pressure roller 33 and the like rotate to follow the lower pressure roller 35 through the nip portion N. The lower pressure roller 35 is provided with a pressure spring 35*a* and a slide cam 35*b*.

The motor M2 rotates the slide cam 35*b* around a shaft 35*c*. The pressure spring 35*a* is connected to the rotation axis of the lower pressure roller 35 at one end and engaged with the slide cam 35*b* at the other end.

The motor M2 rotates the slide cam 35*b* around the shaft 35*c* in response to a command from the control unit 50. The motor M2 urges the lower pressure roller 35 through the pressure spring 35*a* in the direction indicated with arrow F. The fixing apparatus of the first embodiment can adjust the nipping pressure.

Figure 3:
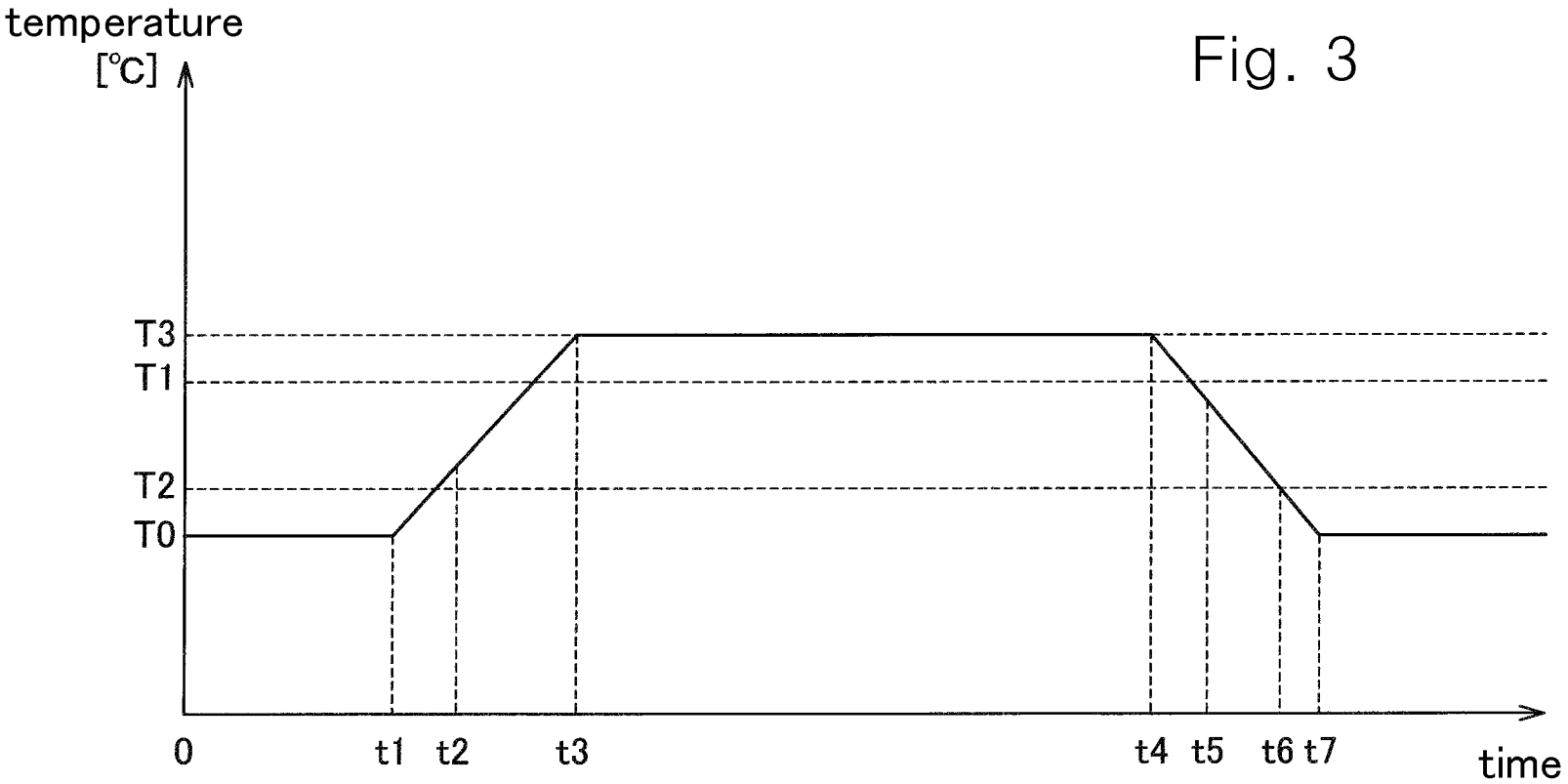
FIG. 3 is a timing chart showing the transition of the temperature of a fixing belt of the fixing unit shown in FIG. 1.

The control unit 50 of the first embodiment controls the temperature of the fixing belt 31 as follows. FIG. 3 is a timing chart showing the transition of the temperature of the fixing belt 31.

First, at time 0 as illustrated in FIG. 3, the control unit 50 controls the temperature of the fixing belt 31 to a stand-by temperature T0, which is lower than a first temperature T1, while no job execution command to perform image formation is issued (i.e., in a stand-by state). The first temperature T1 is such a temperature that paper trouble might occur if the continuous paper P is continuously heated at a temperature not lower than the first temperature. In this first embodiment, it is assumed that the continuous paper P is a resin base synthetic paper which is made mainly of polypropylene resin so that the first temperature T1 is 160° C. to 165° C. corresponding to the melting point of polypropylene resin.

Particularly, the control unit 50 maintains the temperature of the belt 31 to be lower than the softening point T2 of toner (approximately 120° C.) at time 0. Specifically, the control unit 50 maintains the temperature of the belt 31 at a stand-by temperature T0 of 100° C. The control unit 50 maintains the fixing belt 31 at the stand-by temperature T0 by periodically turning on the heat source 32*a* or controlling the heat source 32*a* by a predetermined PWM method.

If a job execution command is issued at time t1, the control unit 50 turns on the heat source 32*a* (for example, the PWM duty cycle is set to 100%). The temperature of the fixing belt 31 thereby starts elevating. On the other hand, the control unit 50 conveys the continuous paper P by driving the rollers respectively in response to the job execution command issued at time t1. The main control unit 3 of the image forming apparatus body 1B also drives the respective rollers to form an image.

It is assumed here that the fixing unit 30 is reached by the leading edge of the first toner image formed by the image forming apparatus body 1B at time t2. At this time, the temperature of the fixing belt 31 is elevated at least no lower than the softening point T2 of toner. Namely, the control unit 50 controls the temperature of the fixing belt 31 in order that the temperature of the fixing belt 31 rises to the softening point T2 of toner or a higher temperature at the time when the nip portion N is reached by the toner images formed on the continuous paper P. Specifically, the temperature rising rate of the fixing belt 31 and the heat source 32*a* is set up in order that the temperature of the fixing belt 31 rises to the softening point T2 of toner or a higher temperature between time t1 and time t2. Because of this, the control unit 50 turns on the halogen heater at time t1 so that the temperature of the fixing belt 31 is necessarily elevated to the softening point T2 of toner or a higher temperature at time t2.

The temperature of the fixing belt 31 reaches a target temperature T3 (for example, 200° C.) at time t3. As shown in FIG. 3, at time t2, the temperature of the fixing belt 31 has not reached the target temperature T3 yet. Because of this, there is the possibility that the fixing performance is insufficient after time t2 but before time t3.

From this fact, when conveying the continuous paper P with such a timing that the unfixed toner image reaches the nip portion N before the temperature of the fixing belt 31 rises to the target temperature T3, the control unit 50 decelerates the rotational speeds of the fixing belt 31 and the lower pressure roller 35 to be lower than the rotational speed when the temperature of the fixing belt 31 is maintained at the target temperature T3. In accordance with the fixing apparatus of the first embodiment, thereby, it is possible to prevent an fixing process from being insufficient, even when the temperature of the fixing belt 31 is below the target temperature T3 so that insufficient fixing is likely, by decreasing the rotational speeds of the fixing belt 31 and the lower pressure roller 35.

Likewise, when conveying the continuous paper P to the nip portion N with such a timing that the unfixed toner image reaches the nip portion N before the temperature of the fixing belt 31 rises to the target temperature T3, the control unit 50 increases the nipping pressure to be higher than the nipping pressure which is applied when the fixing belt 31 is maintained at the target temperature T3. By this configuration, it is possible to prevent an insufficient fixing process by increasing the nipping pressure before the fixing belt 31 reaches the target temperature T3 so that insufficient fixing is likely.

The control unit 50 adjusts the rotational speeds of the fixing belt 31 and the lower pressure roller 35 by controlling the drive motor M1. The control unit 50 controls the motor M2 to adjust the nipping pressure by adjusting the bias force F of the pressure spring 35*a*. Preferably, the rotational speeds and the nipping pressure are continuously adjusted in accordance with the temperature of the fixing belt 31. Alternatively, the adjustment can be performed in a stepwise manner.

The fixing unit 30 performs a fixing process with an ordinary rotational speed and an ordinary nipping pressure in a period between time t3 and time t4. In this period, the control unit 50 controls the heat source 32*a* to maintain the fixing belt 31 at the target temperature T3 by periodically turning on the heat source 32*a* or by a predetermined PWM method. The control unit 50 turns off the heat source 32*a* at time t4. The temperature of the fixing belt 31 then starts falling down.

At time t5, the tail end of the last toner image of the job reaches the fixing unit 30. At this time, the temperature of the fixing belt 31 is elevated to at least the softening point T2 of toner.

The control unit 50 halts the rollers which convey the continuous paper P at time t6, and the temperature of the fixing belt 31 reaches the stand-by temperature T0 at time t7. As illustrated in FIG. 3, the temperature of the fixing belt 31 falls down from the target temperature T3 at time t5. Because of this, there is the possibility that the fixing performance is insufficient at time t5.

From this fact, when conveying the continuous paper P to the nip portion N after lowering the temperature of the fixing belt 31 until the stand-by temperature T0 is reached, the control unit 50 controls the rotational speeds of the fixing belt 31 and the lower pressure roller 35 to be lower than the rotational speed when the temperature of the fixing belt 31 is the target temperature T3. Likewise, the control unit 50 increases the nipping pressure to be higher than the nipping pressure which is applied when the fixing belt 31 is maintained at the target temperature T3. By this configuration, it is possible to prevent a fixing process from being insufficient.

The adjustment of the rotational speed and the nipping pressure can be performed by controlling the drive motor M1 and the motor M2. Also, in this case, while it is preferred to continuously adjust the rotational speed and the nipping pressure, the adjustment can be performed in a stepwise manner.

The control unit 50 obtains the time t4 in advance by a predetermined operation. When a job execution command is issued, the control unit 50 predicts the time when a fixing process is completed on the basis of the number of pages to be printed or the like. The control unit 50 calculates the time t4 as a predetermined time before the fixing process is completed. This predetermined time is determined, for example, on the basis of the temperature dropping characteristics of the fixing belt 31 which is stored in advance. Specifically, the control unit 50 calculates the time t4 on the basis of the temperature dropping characteristics of the fixing belt 31 in order that the temperature of the fixing belt 31 is elevated to the softening point T2 of toner or a higher temperature when the tail end of the last toner image of the job reaches the fixing unit 30, i.e., at time t5, and that the temperature of the fixing belt 31 drops no upper than the first temperature T1 when the rollers which convey the continuous paper P is halted, i.e., between time t5 and time t6.

The time t4 can be calculated not only by predicting the time when a fixing process is completed (i.e., when the last toner image is passed through the nip portion N) but also by any other appropriate method. For example, the control unit 50 can calculate the time t4 as a second predetermined time before the time that is predicted as the time when the rollers are halted and stop successively conveying the continuous paper P to the nip portion N, or as a third predetermined time before the time that is predicted as the time when the temperature of the fixing belt 31 reaches the stand-by temperature T0. In the following description of the first embodiment, the completion time of a job is defined as either one of the time when a fixing process is completed, the halting time when the rollers are halted and the time when the temperature of the fixing belt 31 reaches the stand-by temperature T0.

The fixing apparatus of the first embodiment controls the heat source 32*a* in response to a job execution command which is issued in a stand-by state to elevate the temperature of the fixing belt 31 so that the temperature of the fixing belt 31 rises from the stand-by temperature T0 to the target temperature T3 higher than the first temperature T1. Then, the fixing apparatus controls the heat source 32*a* to lower the temperature of the fixing belt 31 in advance of completing the job in order that the temperature of the fixing belt 31 is lower than the first temperature T1 at the time when the job is completed. By this configuration, severe damage of the fixing apparatus and degradation of the output quality of printing can be avoided by inhibiting paper trouble from occurring in a stand-by state while no job execution command is issued.

Figure 4:
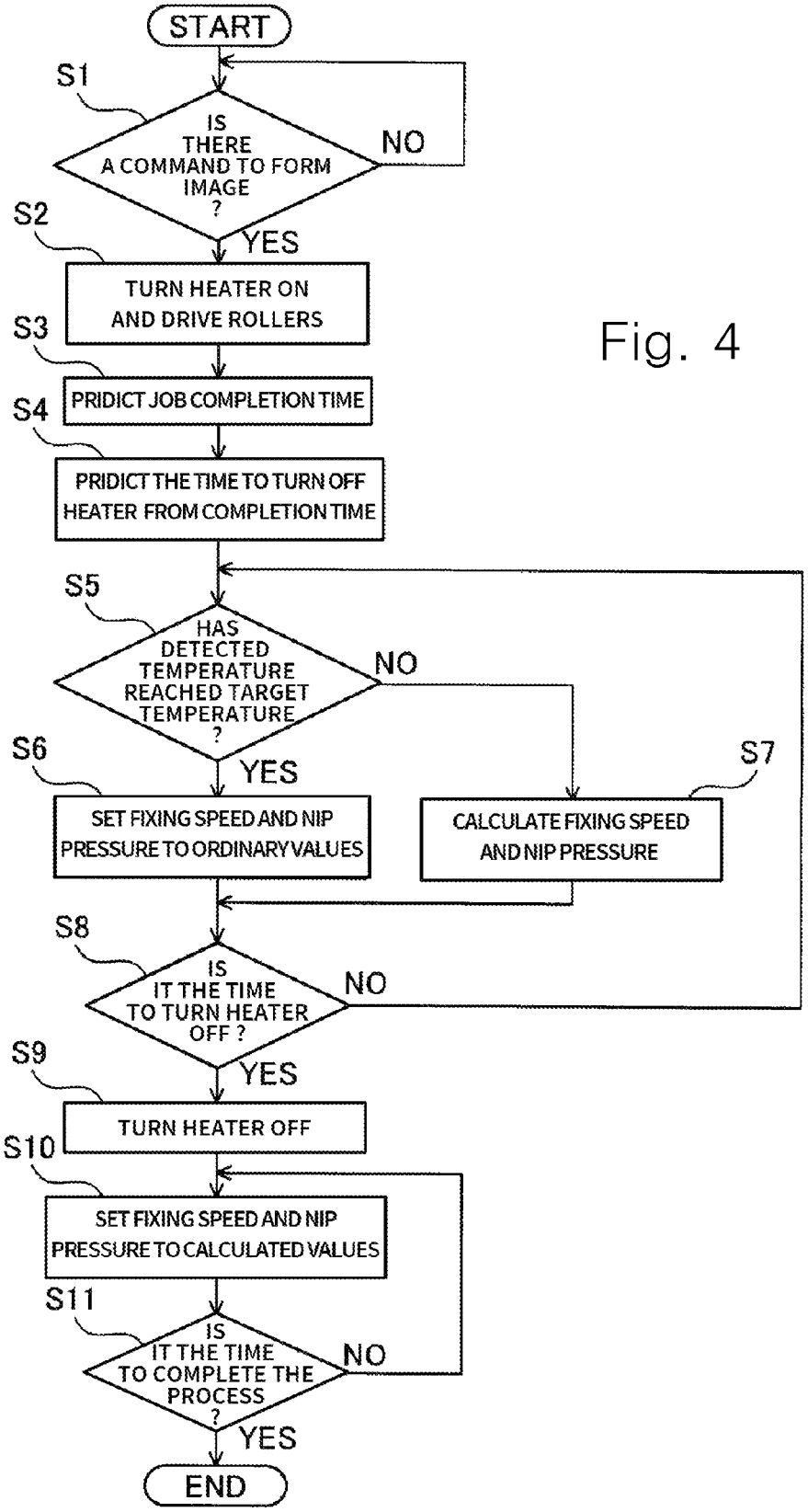
FIG. 4 is a flow chart for showing a temperature control method of the fixing apparatus of the first embodiment.

Next, the operation of the fixing apparatus of the first embodiment will be explained. FIG. 4 is a flow chart for showing a temperature control method of the fixing apparatus of the first embodiment. Incidentally, it is assumed that the fixing apparatus is in a stand-by state when starting the process shown in FIG. 4.

As shown in FIG. 4, the control unit 50 first determines whether or not there is a job execution command to perform image formation (S1). The job execution command is input from the main control unit 3 so that the control unit 50 first determines whether or not there is a job execution command on the basis of the signals output from the main control unit 3. If it is determined that no job execution command to perform image formation is issued (S1: NO), the control unit 50 repeats this determination until a job execution command is issued.

Conversely, if it is determined that a job execution command to perform image formation is issued (S1: YES), the control unit 50 turns on the halogen heater which is the heat source 32*a*, and drives the rollers which are used to successively convey the continuous paper P to the nip portion N (S2).

The control unit 50 predicts the time when the job is completed (S3). This prediction is performed on the basis of the number of pages to be printed or the like. The control unit 50 predicts the time when the job is completed also taking into consideration the decreased rotational speeds of the fixing belt 31 and the lower pressure roller 35 as shown in FIG. 3 in the period between time t1 and time t3 and in the period between time t4 and time t6.

The control unit 50 predicts the time at which the halogen heater as the heat source 32*a* is turned off (i.e., the time t4 as shown in FIG. 3) by calculating the predetermined time before the job is completed (S4). Furthermore, the control unit 50 determines whether or not the temperature detected by the temperature sensor T has reached the target temperature T3 (S5).

If it is determined that the target temperature T3 is already reached (S5: YES), the control unit 50 controls the rotational speeds of the fixing belt 31 and the lower pressure roller 35 to achieve an ordinary fixing speed and controls the nipping pressure to an ordinary value (S6). The process then proceeds to step S8.

Conversely, if it is determined that the target temperature T3 has not been reached (S5: NO) yet, the control unit 50 calculates the fixing speed and the nipping pressure in accordance with the temperature of the fixing belt 31 detected by the temperature sensor T to control the fixing belt 31 and the lower pressure roller 35 to achieve the calculated fixing speed and the calculated nipping pressure (S7). The process then proceeds to step S8.

In step S8, the control unit 50 determines if the current time is an OFF time, predicted in step S4, at which the halogen heater as the heat source 32*a* is turned off (S8). If it is determined that the current time is not the OFF time (S8: NO), the process proceeds to step S5.

Conversely, if it is determined that the current time is the OFF time (S8: YES), the control unit 50 turns off the halogen heater which is the heat source 32*a* (S9). The control unit 50 calculates the fixing speed and the nipping pressure in accordance with the temperature of the fixing belt 31 detected by the temperature sensor T to control the fixing belt 31 and the lower pressure roller 35 to achieve the calculated fixing speed and the calculated nipping pressure (S10).

In step S3, the control unit 50 determines if the current time is the job completion time predicted in step S3 (S11). If it is determined that the current time is not the completion time (S11: NO), the process proceeds to step S10. Conversely, if it is determined that the current time is the completion time (S11: YES), the process shown in FIG. 4 is then finished.

Meanwhile, in the case where the job completion time is the time when a fixing process is completed, the rollers driven in step S2 are halted X seconds (X is an arbitrary positive number) after determining in the affirmative in step 11. Also, in the case where the job completion time is the halting time of the rollers, the rollers are halted when determining in the affirmative in step 11. Furthermore, in the case where the job completion time is the time when the temperature of the fixing belt 31 reaches the stand-by temperature T0, the rollers are halted Y seconds (Y is an arbitrary positive number) before determining in the affirmative in step 11.

In accordance with the fixing apparatus and the temperature control method of the first embodiment as has been discussed above, the temperature of the fixing belt 31 is controlled to be the stand-by temperature T0 lower than the first temperature T1 which is set up in advance as such a temperature that paper trouble might occur if the continuous paper P is continuously heated at a temperature not lower than the first temperature in a stand-by state. Because of this, the fixing apparatus need not be provided with a mechanism of retracting the continuous paper P from the fixing belt 31 so that the continuous paper P is inhibited from causing troubles between the fixing belt 31 and the lower pressure roller 35 in a stand-by state. It is therefore possible to suppress cost increase and the complication of the system, and prevent the fixing apparatus from being seriously damaged and the output quality of printing process from being significantly degraded.

Also, when a job execution command is issued in a stand-by state, the fixing apparatus elevates the temperature of the fixing belt 31 so that the temperature of the fixing belt 31 rises to the target temperature T3. The fixing apparatus can thereby appropriately fix unfixed toner to the continuous paper P. Furthermore, the fixing apparatus lowers the temperature of the fixing belt 31 before the job is completed in order that the temperature of the fixing belt 31 is lower than the first temperature T1 at the time when the job is completed. Because of this, the continuous paper P is inhibited from causing troubles between the fixing belt 31 and the lower pressure roller 35 in a stand-by state after completing the job.

Also, the first temperature T1 is set to the melting point of polypropylene resin. Because of this, in the case where the continuous paper P is a resin base synthetic paper which is made mainly of polypropylene resin, the continuous paper P is prevented from melting between the fixing belt 31 and the lower pressure roller 35 in a stand-by state and seriously damaging the fixing apparatus.

Furthermore, in the period after starting elevating the temperature of the fixing belt 31 until reaching the target temperature T3, and in the period after starting lowering the temperature of the fixing belt 31 until reaching the stand-by temperature T0, the fixing apparatus lowers the rotational speeds of the fixing belt 31 and the lower pressure roller 35 below the rotational speed when the temperature of the fixing belt 31 is the target temperature T3. Because of this, the fixing apparatus can prevent an fixing process from being insufficient, even when the temperature of the fixing belt 31 is below the target temperature T3 so that insufficient fixing is likely, by decreasing the rotational speeds of the fixing belt 31 and the lower pressure roller 35.

Also, in the period after starting elevating the temperature of the fixing belt 31 until reaching the target temperature T3, and in the period after starting lowering the temperature of the fixing belt 31 until reaching the stand-by temperature T0, the fixing apparatus elevates the nipping pressure beyond the nipping pressure which is applied when the fixing belt 31 is maintained at the target temperature T3. It is thereby possible to prevent an fixing process from being insufficient by increasing the nipping pressure, even when the temperature of the fixing belt 31 is below the target temperature T3 so that insufficient fixing is likely.

Furthermore, the fixing apparatus controls the heat source 32*a* in order that the temperature of the fixing belt 31 rises to the softening point T2 of toner or a higher temperature at the time when an unfixed toner image reaches the nip portion N. Because of this, when elevating the temperature of the fixing belt 31 from the stand-by temperature T0, the toner image is prevented from reaching the nip portion N at the softening point T2 of toner or a lower temperature. Still further, also when lowering the temperature of the fixing belt 31 from the target temperature T3, the toner image is prevented from reaching the nip portion N at the softening point T2 of toner or a lower temperature. It is therefore possible to prevent a fixing process from being insufficient.

In addition, the image forming apparatus 1 of the first embodiment is provided with the image forming units 10Y, 10M, 10C and 10K which form unfixed toner images on the continuous paper P, and the aforementioned fixing apparatus which fixes the unfixed toner images formed by the image forming units 10Y, 10M, 10C and 10K on the continuous paper P. It is therefore possible to provide the image forming apparatus 1 which can suppress cost increase and the complication of the system, and prevent the fixing apparatus from being seriously damaged and the output quality of printing process from being significantly degraded.

Figure 5:
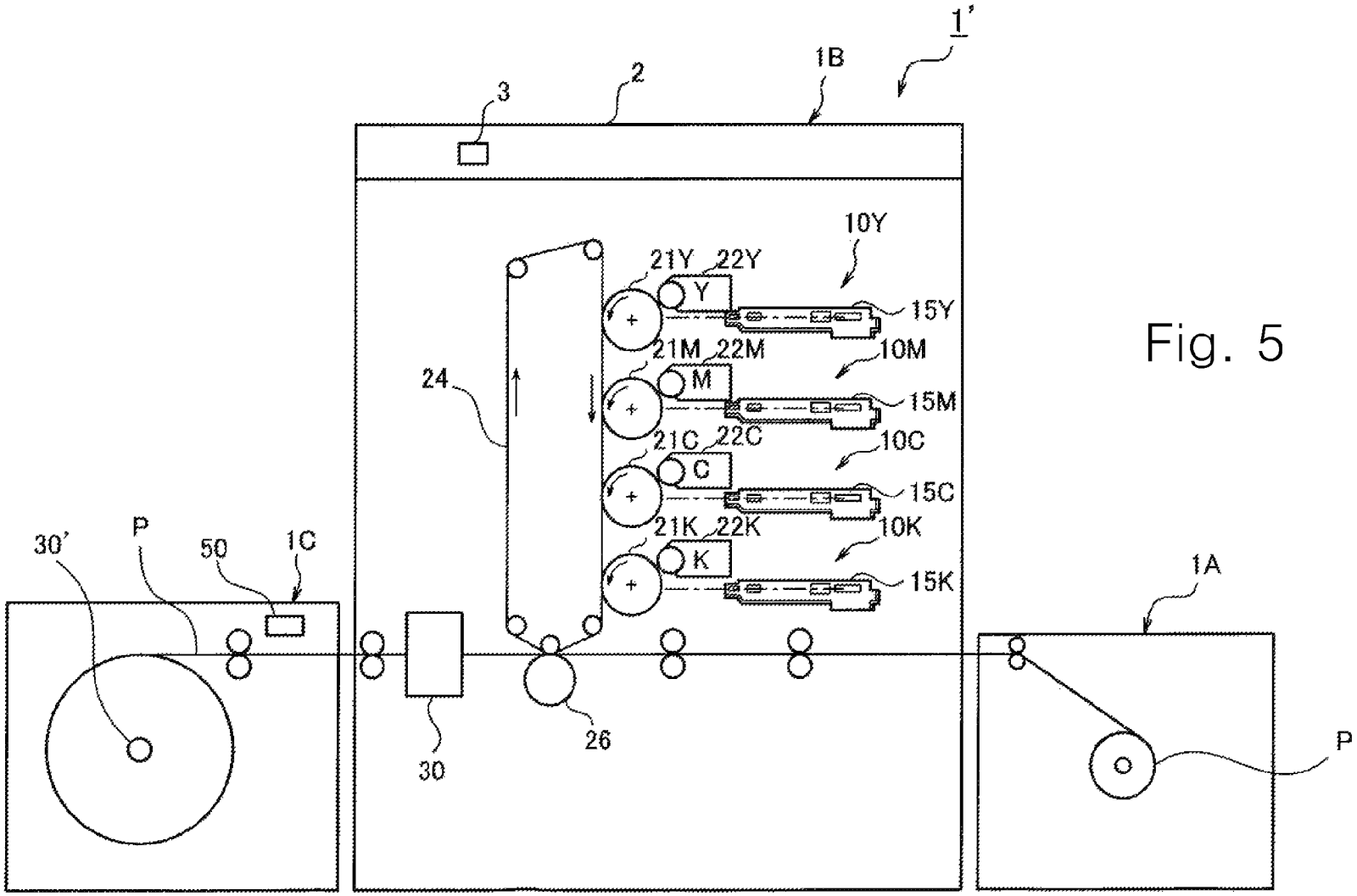
FIG. 5 is a view for showing the configuration of the image forming apparatus in accordance with a second embodiment.

Next, a second embodiment of the present invention will be explained. The image forming apparatus of the second embodiment is similar to that of the first embodiment except for some structure. In what follows, the differences from the first embodiment will be explained. FIG. 5 is a view for showing the configuration of the image forming apparatus 1' in accordance with the second embodiment.

As shown in FIG. 5, in the case of the image forming apparatus 1' of the second embodiment, the fixing unit 30 is incorporated in the image forming apparatus body 1B. The fixing apparatus consists of the fixing unit 30 and the main control unit 3 (control unit).

Since the fixing apparatus of the first embodiment is implemented within another housing which is separated from the image forming apparatus body 1B, a buffer space B can be provided between the image forming apparatus body 1B and the continuous paper winding unit 1C for slacking the continuous paper P. For example, when the rotational speeds of the fixing belt 31 and the lower pressure roller 35 are reduced in a period between time t1 and time t2 and in a period between time t4 and time t5, the differential speed can be absorbed by the buffer space B even without reducing the speed of forming images in the image forming apparatus body 1B.

However, the image forming apparatus body 1B of the second embodiment incorporates the fixing apparatus and the image forming units 10Y, 10M, 10C and 10K within the same housing. Thereby, because of the limited space available in the image forming apparatus body 1B, no or only a very small space can be provided as the buffer space B.

Accordingly, when reducing the rotational speeds of the fixing belt 31 and the lower pressure roller 35 below the rotational speed when the temperature of the fixing belt 31 is maintained at the target temperature T3, the main control unit 3 of the second embodiment also reduces the speed of forming images in the image forming units 10Y, 10M, 10C and 10K respectively. The main control unit 3 reduces the peripheral speeds of the photoreceptor drums 21Y, 21M, 21C and 21K, the peripheral speed of the intermediate transfer belt 24 and the conveying speed of the continuous paper P respectively.

Particularly, the main control unit 3 of the second embodiment preferably controls the above peripheral speeds and the conveying speed in agreement with the rotational speeds of the fixing belt 31 and the lower pressure roller 35. This is because the buffer space need no longer be provided with this configuration.

As has been discussed above, in accordance with the fixing apparatus and the temperature control method of the second embodiment, there are the same advantages as the first embodiment.

Furthermore, the image forming apparatus 1' of the second embodiment is provided with the image forming units 10Y, 10M, 10C and 10K within the same housing, and reduces the image formation speed in the image forming units 10Y, 10M, 10C and 10K when reducing the rotational speeds of the fixing belt 31 and the lower pressure roller 35. Because of this, even in the case of such a structure that a buffer space for slacking the continuous paper P can hardly be provided between the fixing apparatus and the image forming units 10Y, 10M, 10C and 10K, it is possible to inhibit the size of the system from increasing by minimizing the differential speed between the fixing apparatus and the image forming units 10Y, 10M, 10C and 10K. For example, if the fixing apparatus and the image forming units 10Y, 10M, 10C and 10K are rotated at the same speed, there is no need for providing such a buffer space for slacking the continuous paper P.

The fixing apparatus, the image forming apparatus and the temperature control method of the fixing apparatus have been explained on the basis of the embodiments in accordance with the present invention. However, it is not intended to limit the present invention to the precise form described, and obviously many modifications and variations are possible without departing from the scope of the invention as well as any combination of these embodiments.

For example, the configurations, the numerals and the like are not limited to those as described above, but can be changed in any appropriate manner. Also, in the case of the above embodiment, the fixing apparatus is of a belt nip type. However, the present invention is not limited thereto but can be applied to a fixing apparatus having a pair of rollers between which the nip portion N is formed. In this case, the pair of rollers include the lower pressure roller 35 and a roller serving as the heated object provided in place of the fixing belt 31.

Furthermore, the stand-by temperature T0 of the above embodiments is lower than the softening point T2 of toner. However, the present invention is not limited thereto but the stand-by temperature T0 can be the softening point T2 of toner or a higher temperature as long as it is lower than the first temperature T1.

Still further, the first temperature T1 of the above embodiments is 160° C. to 165° C. corresponding to the melting point of polypropylene resin. However, the present invention is not limited thereto but the first temperature T1 can be a temperature at which blisters are formed on a coated paper, or a temperature at which a standard paper is discolored.

What is claimed is:

1. A fixing apparatus comprising:

a heating unit configured to heat a heated object which is either a roller or an endless belt stretched around a plurality of rollers;

an another roller pressed into contact with the heated object in order to form a nip portion between the another roller and the heated object; and a control unit configured to control the temperature of the heated object by controlling the heating unit, the fixing apparatus being configured to fix an unfixed toner image formed on a continuous paper to the continuous paper by heat from the heated object under a nipping pressure applied at the nip portion, wherein the control unit controls the temperature of the heated object to be a stand-by temperature lower than such a first temperature, which is set up in advance, that paper trouble might occur if the continuous paper is continuously heated at a temperature not lower than the first temperature in a stand-by state in which fixing is not performed;

wherein, when a job execution command is issued to perform image formation in the stand-by state, the control unit controls the heating unit to elevate the temperature of the heated object so that the temperature of the heated object rises from the stand-by temperature to a target temperature higher than the first temperature, and to lower the temperature of the heated object in advance of completing the job so that the temperature of the heated object has reached the stand-by temperature lower than the first temperature at the time when the job is completed.

2. The fixing apparatus of claim 1, wherein the first temperature is the melting point of polypropylene resin.

3. The fixing apparatus of claim 1, wherein, when the job execution command is issued to perform image formation, the control unit conveys the continuous paper with such a timing that the unfixed toner image reaches the nip portion in at least one of a period after starting heating the heated object until the temperature of the heated object reaches the target temperature, and a period after starting lowing the heated object until the temperature of the heated object drops to the stand-by temperature, and decelerates in this at least one of the periods the rotational speeds of the another roller and the heated object to be lower than the rotational speeds at which the another roller and the heated object rotate when the temperature of the heated object is the target temperature.

4. The fixing unit of claim 1, wherein, when the job execution command is issued to perform image formation, the control unit conveys the continuous paper with such a timing that the unfixed toner image reaches the nip portion in at least one of a period after starting heating the heated object until the temperature of the heated object reaches the target temperature, and a period after starting lowing the heated object until the temperature of the heated object reaches the stand-by temperature, and increases the nipping pressure to be higher than the nipping pressure which is applied when the fixing belt is maintained at the target temperature.

5. The fixing unit of claim 3 wherein the control unit controls the heating unit in order that the temperature of the heated object reaches the softening point of toner or a higher temperature at the time when the nip portion is reached by the toner images formed on the continuous paper in at least one of the periods.

6. An image forming apparatus comprising:

an image forming unit configured to form an unfixed toner image on a continuous paper; and the fixing unit recited in claim 1 and configured to fix the unfixed toner image formed by the image forming unit on the continuous paper.

7. An image forming apparatus comprising:

an image forming unit configured to form an unfixed toner image on a continuous paper; and the fixing unit recited in claim 3, incorporated in the same housing as the image forming unit, and configured to fix the unfixed toner image formed by the image forming unit on the continuous paper, wherein the control unit conveys the continuous paper with such a timing that the unfixed toner image reaches the nip portion in at least one of the periods, and decelerates in this at least one of the periods the rotational speeds of the another roller and the heated object to be lower than the rotational speeds at which the another roller and the heated object rotate when the temperature of the heated object is the target temperature.

8. A temperature control method of controlling a heated object of a fixing apparatus which includes: a heating unit configured to heat the heated object which is either a roller or an endless belt stretched around a plurality of rollers; and an another roller pressed into contact with the heated object in order to form a nip portion between the another roller and the heated object, the fixing apparatus being configured to fix an unfixed toner image formed on a continuous paper to the continuous paper by heat from the heated object under a nipping pressure applied at the nip portion, the temperature control method comprising a controlling step of controlling the heating unit to control the temperature of the heated object to be a stand-by temperature lower than such a first temperature, which is set up in advance, that paper trouble might occur if the continuous paper is continuously heated at a temperature not lower than the first temperature in a stand-by state in which fixing is not performed;

wherein, when a job execution command is issued to perform image formation in the stand-by state, in the controlling step, the heating unit is controlled to heat the heated object so that the temperature of the heated object rises from the stand-by temperature to a target temperature higher than the first temperature, and to lower the temperature of the heated object in advance of completing the job so that the temperature of the heated object has reached the stand-by temperature lower than the first temperature at the time when the job is completed.

9. The temperature control method of claim 8, wherein the first temperature is the melting point of polypropylene resin.

10. The temperature control method of claim 8, wherein, when the job execution command is issued to perform image formation in the stand-by state, in the controlling step, the continuous paper is conveyed with such a timing that the unfixed toner image reaches the nip portion in at least one of a period after starting heating the heated object until the temperature of the heated object reaches the target temperature, and a period after starting lowing the heated object until the temperature of the heated object drops to the stand-by temperature, and in this at least one of the periods the rotational speeds of the another roller and the heated object are decelerated to be lower than the rotational speeds at which the another roller and the heated object rotate when the temperature of the heated object is the target temperature.

11. The temperature control method of claim 8, wherein, when the job execution command is issued to perform image formation in the stand-by state, in the controlling step, the continuous paper is conveyed with such a timing that the unfixed toner image reaches the nip portion in at least one of a period after starting heating the heated object until the temperature of the heated object reaches the target temperature, and a period after starting lowing the heated object until the temperature of the heated object reaches the stand-by temperature, and the nipping pressure is increased to be higher than the nipping pressure which is applied when the fixing belt is maintained at the target temperature.

12. The temperature control method of claim 10 wherein the heating unit is controlled in order that the temperature of the heated object reaches the softening point of toner or a higher temperature at the time when the nip portion is reached by the toner images formed on the continuous paper in at least one of the periods.

* * * * *